US005655671A

United States Patent [19]

Barry et al.

[11] Patent Number: 5,655,671

[45] Date of Patent: Aug. 12, 1997

[54] DISPLAY STAND FOR INCENSE STICKS

[76] Inventors: Ralph E. Barry; Gloria A. Barry, both of P.O. Box 4755, Stateline, Nev. 89449

[21] Appl. No.: 586,340

[22] Filed: Jan. 16, 1996

[51] Int. Cl.[6] ..... A47F 7/00

[52] U.S. Cl. ..... 211/70; 211/163; 211/60.1; D11/131.1

[58] Field of Search ..... 211/60.1, 70, 163; D11/131.1

[56] References Cited

U.S. PATENT DOCUMENTS

| | | | |
|---|---|---|---|
| 196,599 | 10/1877 | Sheldon | 211/70 X |
| 2,325,483 | 7/1943 | Davis | 211/60.1 |
| 2,881,947 | 4/1959 | Hancock | 211/60.1 X |
| 3,826,378 | 7/1974 | Novak | 211/70 X |
| 5,397,005 | 3/1995 | Taccolini | 211/70 |
| 5,544,764 | 8/1996 | Cima | 211/60.1 |

*Primary Examiner*—Robert W. Gibson, Jr.
*Attorney, Agent, or Firm*—Harold D. Messner

[57] ABSTRACT

The present invention relates a rotatable display stand for a plurality of incense sticks, such display stand including a first planar disk of diameter D1 having an upright axis of symmetry substantially normal to the earth's surface, and a broad surface normal to such surface for supporting a series of cylindrical incense stick holders in upright positions. In one aspect, the first planar disk is stacked a predetermined height H above and rotatable relative to a rigid base using a metallic bearing mount. Such mount includes upper and lower races one of which being rigidly mounted to the broad surface of the base and the other mounted to the first planar disk to permit rotation of the first dick as well as second and third disks stacked above the first disk. In another aspect of the invention, such height H is sufficient to permit insertion of a pair of drawers in the space between the rigid base and the first planar disk for stowage of matches, plastic bags and the like, as well as support a pair of chest handles for permitting easy portability of the invention. In yet another aspect, attachment of the first, second and third disks is via insertion of a compression rod having at least threaded ends through vertically aligned small openings in the disks. Positional relocation of fasteners or nuts at the ends of the compression rod creates a compressional force at the broad surfaces of the disks through a stacked pair of spacer tubes concentric of the compression rod.

20 Claims, 4 Drawing Sheets

DISPLAY STAND FOR INCENSE STICKS

SCOPE OF INVENTION

The present invention relates to display stands and more particularly to a rotatable display stand for a plurality of incense sticks, such display stand including a first planar disk of diameter D1 having an upright axis of symmetry substantially normal to the earth's surface, and a broad surface normal to such surface for supporting a series of cylindrical incense stick holders in upright positions. In one aspect, the first planar disk is stacked a predetermined height H above and rotatable relative to a rigid base using a metallic bearing mount. Such mount includes upper and lower races one of which being rigidly mounted to the broad surface of the base and the other mounted to the first planar disk and is called a "Lazy Susan" wheel mount bearing.

In another aspect of the invention, such height H is sufficient to permit insertion of a pair of drawers in the space between the rigid base and the first planar disk for stowage of matches for lighting sample sticks supported at a second planar disk of diameter D2 stacked in upright position above both the first planar disk and an intermediate third planar disk of diameter D1 where D1>D2.

In yet another aspect, attachment of the first, second and third disks is via insertion of a compression rod having at least threaded ends through vertically aligned small openings in the disks. Positional relocation of nuts at the ends of the compression rod creates a compressional force at the broad surfaces of the disks through a stacked pair of spacer tubes concentric of the compression rod, one of which being placed between the first disk and the third disk and the other between the third disk and the second disk.

In still yet another aspect, display of the cylindrical holders is enhanced by forming a plurality of circular openings parallel to the axis of symmetry of the third disk for stabilizing their positions after the cylindrical stick holders are inserted therethrough and forming the holders of varying heights and then positioning them in various positions in a radial direction relative to the coincident axes of symmetry of the discs such that the tallest are closest to such axes and the shortest are farthest therefrom with intermediate height holders in between.

BACKGROUND OF THE INVENTION

Experience has shown that various designs of display stands are available. However, I an unaware of any stands that display incense sticks of various essences that displays are large quantity of sticks, is rotatable or is easily transportable from point-to-point by the vendor.

SUMMARY OF THE INVENTION

The present invention relates a rotatable display stand for a plurality of incense sticks, such display stand including a first planar disk of diameter D1 having an upright axis of symmetry substantially normal to the earth's surface, and a broad surface normal to such surface for supporting a series of cylindrical incense stick holders in upright positions. In one aspect, the first planar disk is stacked a predetermined height H above and rotatable relative to a rigid base using a metallic bearing mount. Such mount includes upper and lower races one of which being rigidly mounted to the broad surface of the base and the other mounted to the first planar disk and is called a "Lazy Susan" wheel mount bearing. In another aspect of the invention, such height H is sufficient to permit insertion of a pair of drawers in the space between the rigid base and the first planar disk for storage of matches for lighting sample sticks supported at a second planar disk of diameter D2 stacked in upright position above both the first planar disk and an intermediate third planar disk of diameter D1 where D1>D2. In yet another aspect, attachment of the first, second and third disks is via insertion of a compression rod having at least threaded ends through vertically aligned small openings in the disks. Positional relocation of nuts at the ends of the compression rod creates a compressional force at the broad surfaces of the disks through a stacked pair of spacer tubes concentric of the compression rod, one of which being placed between the first disk and the third disk and the other between the third disk and the second disk. In still yet another aspect, display of the cylindrical holders is enhanced by forming a plurality of circular openings parallel to the axis of symmetry of the third disk for stabilizing their positions after the cylindrical stick holders are inserted therethrough and forming the holders of varying heights and then positioning them in various positions in a radial direction relative to the coincident axes of symmetry of the discs such that the tallest are closest to such axes and the shortest are farthest therefrom with intermediate height holders in between.

DETAIL DESCRIPTION OF THE INVENTION

Figure 1:
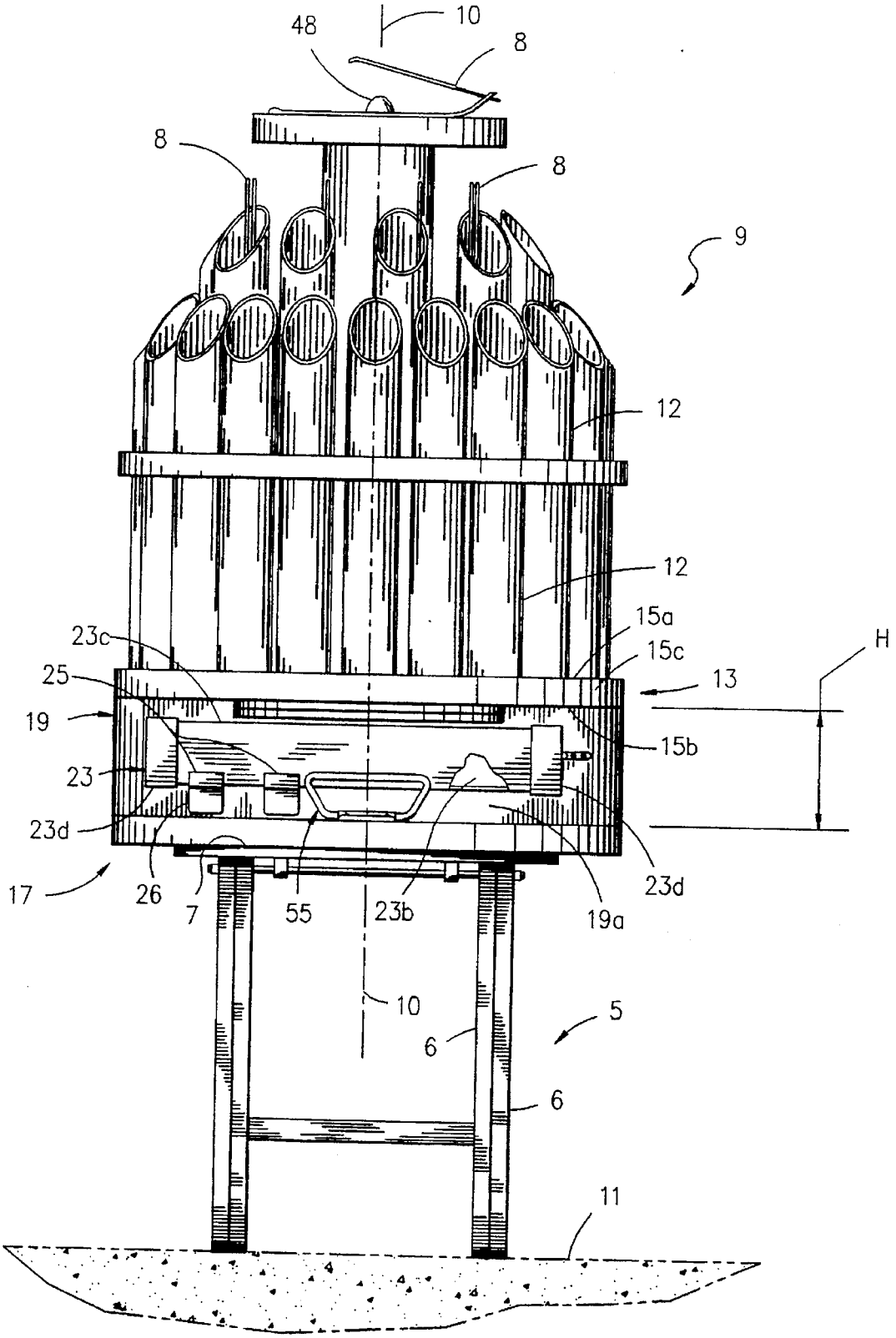
FIG. 1 is a side view of the display stand of the invention supported via a portable table, such display stand including a series of stack planar disks for display of incense.

FIG. 1 show rotatable display stand 9 of the invention having an longitudinal axis of symmetry 10 normal to the earth's surface 11, such display stand 9 resting atop a portable table 5 having foldable legs 6 in contact with the earth's surface 11 and an upper surface 7 also parallel to the earth's surface 11. Purpose of the display stand 9: to display a plurality of incense sticks 8 within a series of incense stick holders 12 supported by a first planar disk 13, such holders 12 ranging in number from 16 to 75 with a range of 32–50 being preferred.

Figure 2:
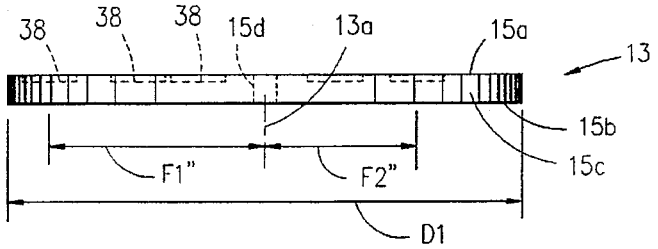
FIG. 2 is a side view of one of the discs used in the formation of the display stand of FIG. 1.

FIG. 2 shows the planar disk 13 in detail.

As shown, such planar disk 13 is of diameter D1; has an upright axis of symmetry 13*a* and includes the following: first and second broad surfaces 15*a*, 15*b*, a circumferential edge 15*c* and a central opening 15*d*.

Returning to FIG. 1, note that upright axis of symmetry of the planar disk 13 is coincident with axis of symmetry 10 of the display stand 9 of the invention and that the upper broad surface 15*a* thereof, supports the plurality of incense stick holders 12. The first planar disk 13 is also seen to be stacked a predetermined height H above a rigid planar base 17.

Figure 3:
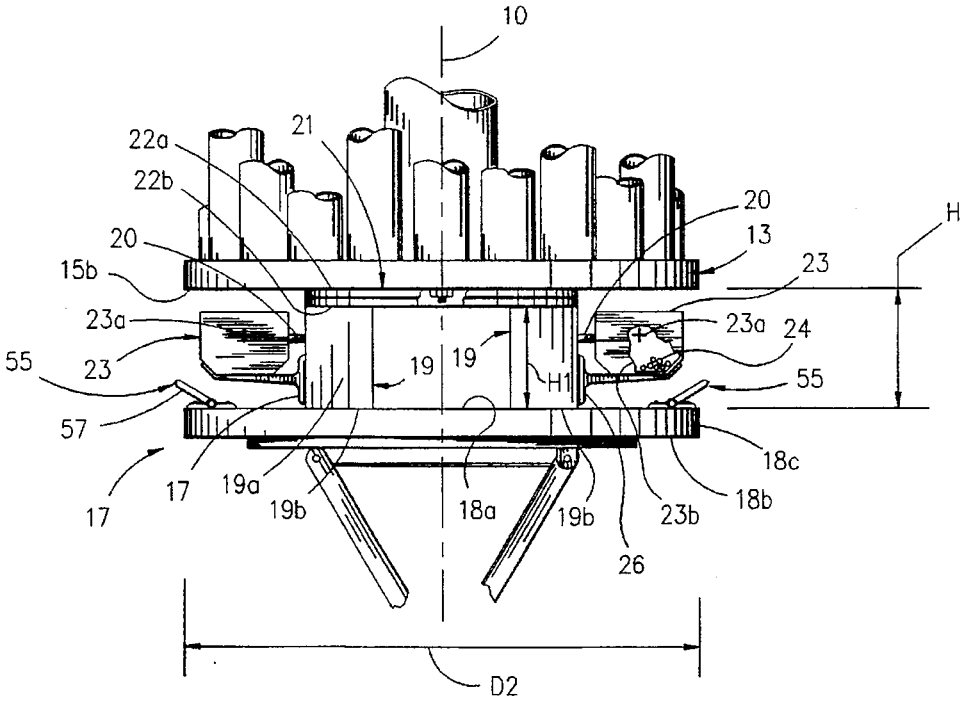
FIG. 3 is a partial front view of the display stand of FIG. 1.

FIG. 3 shows the planar base 17 in more detail.

As shown, the planar base 17 includes upper broad surface 18*a*, lower broad surface 18*b*, cross members 19 with ends 19*a* cut along a bias and lower surface 19*b* attached to the upper broad surface 18*a* of the base 17 and a circumferential edge 18*c* defining a diameter D2 where D2=D1. In operation, the rigid base 17 remains stationary while the first disk 13 is also rotatable about an axis of rotation coincident with the axis of symmetry 10. Such rotation is a function of a conventional metallic turntable bearing mount 21. Such mount 21 includes upper and lower races 22*a*, 22*b*, the lower race 22*b* being rigidly mounted to cross members 19 of the base 17 while the upper race 22*a* being mounted to the lower surface 15*b* of the first disk 13. A preferred mount 21 is manufactured by Shepherd hardware Produces, Three Oakes, Mich. as a "Lazy Susan" turntable bearing, part 9549.

As shown, the height H is sufficient to permit insertion of a pair of drawers 23 in space created between the rigid base 17 and the first planar disk 13 and is, as seen, directly related to the height H1 of the cross members 19. The travel paths 23*a* of the drawers 23 are parallel to the cross members 19 and are terminated by L-shaped stops 20. The drawers 23 each have a cavity 23*b* for stowage of matches 24, plastic bags (not shown) and the like, and are conveniently formed from common plastic gutter sawed to length.

Thereafter, as shown in FIG. 1, the ends of the gutters are fitted with gutter end caps 23*d*. Each drawer 23 is made to slide relative to the base 17 by a pair of gutter hangers 25 having an upright wall 26 attached to upright wall surface 19*a* of the cross member 19. Note also that side wall 23*c* of each drawer 23 is sufficiently strong so that cavity 23*b* can adequately serve as a stowage locale. The purpose of the matches 24: to light a sample of the plurality of incense sticks 8, see FIG. 1, after the former has been attached to incense fire resistant troughs 27, secured to a second planar disk 30.

Figure 4:
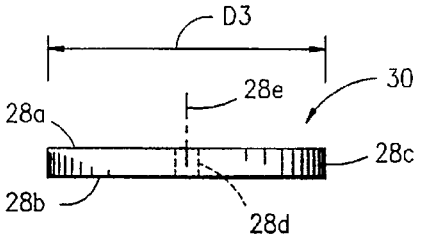
FIG. 4 is a side view of another of the discs used in the formation of the display stand of FIG. 1.

FIG. 4 shows second planar disk 30 in more detail.

As shown, the second planar disk 30 includes an upper broad surface 28*a*, a lower broad surface 28*b*, a circumferentially extending edge 29*c* and a central opening 28*d* concentric of axis of symmetry 28*e*. The second planar disk 30 also has a diameter D3.

Returning to FIG. 1, note that the second planar disk 30 is also concentric of the axis of symmetry 10 of the display stand 9 and is stack above the rigid base 17 and the first disk 13 where the diameters of each are related as follows: D3<D1 or D2. In addition, the second planar disk 30 is also seen to be in an elevated stacking orientation relative to third intermediate disk 31.

Figure 5:
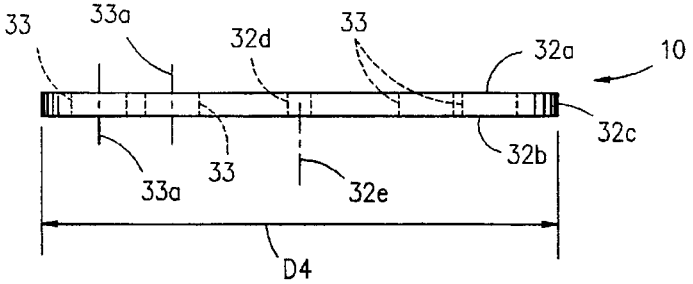
FIG. 5 is a side view of yet another of the discs used in the formation of the display stand of FIG. 1.

FIG. 5 shows third planar disk 31 in detail.

As shown, the third planar disk 31 disk 31 has a diameter D4 that is equal to the diameters D1 and D2 of the first disk 13 and the third disk 31, respectively and includes the following: broad upper planar surface 32*a*; broad lower planar surface 32*b*; a circumferential edge 32*c*; a central opening 32*d* concentric of an axis of symmetry 32*e* and a series of longitudinal openings 33, a few of which are shown in phantom line, all having axes of symmetry 33*a* parallel to axis of symmetry 32*e*.

Figure 6:
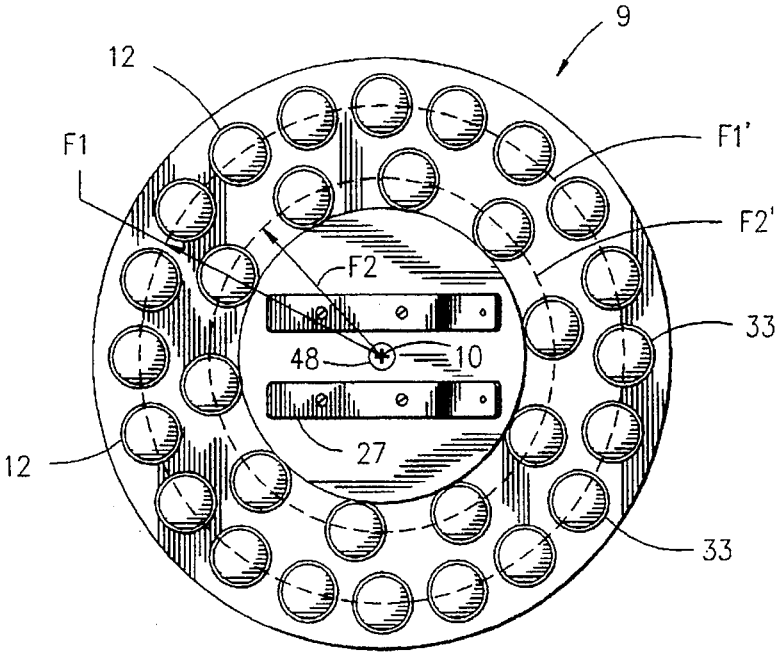
FIG. 6 is a top view of the display stand of FIG. 1.

As shown best in FIG. 6, the longitudinal openings 33 of the third planar disk 31 are positioned at radial common distances F1 or F2 relative to the axis of symmetry 10 of the display stand 9 to define a pair of bolt circles F1' and F2'. Note that openings 33 associated with the bolt circle F1' are more numerous than the openings 33 associated with the bolt circle F2'.

FIG. 7, 8, 9 and 10 illustrate the stick holder 12 in detail.

As shown, each of the stick holders 12 is cylindrical, has side wall 36, a first end terminus 37*a* normal to the axis of symmetry 35 and a second end terminus 37*b* defining a bias plane P1 intersecting the axis of symmetry 35 at an included angle A less than 90 degrees whereby an apex segment 34 at a circumferential edge of side wall 36 is provided. An plastic end cap 2 is inserted within the side wall 36 at the first end terminus 37*a* and includes a side wall 3*a* sized to fit the stick holder, an end wall 3*b* and a swedged outer lip 4 to facilitate insertion.

In FIG. 2, note that a plurality of cavities 38 are formed within upper broad surface 15*a* of the first planar disk 13. The cavities 38 are positioned at the same various radial distances F1 or F2 shown in FIG. 6 relative to the axis of symmetry 10 of the display stand 9 associated with the bolt circles F1' and F2' defining the locations of the longitudinal openings 33 of the third disk 31.

Figure 11:
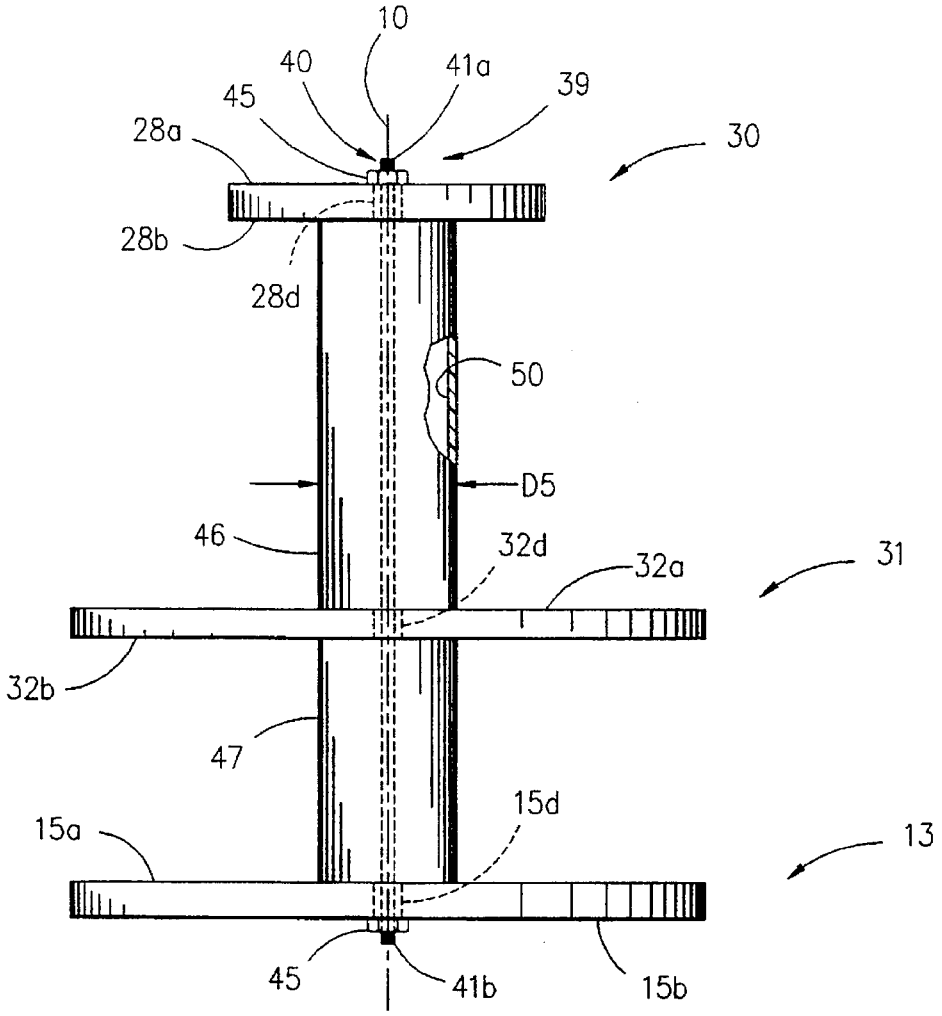
FIG. 11 is a side view of a compression mount used in attaching the discs of FIG. 1 together.

FIG. 11 shows how the first, second and third disks 13, 30,31, respectively are attached to function as a single unit.

As shown, a central compression mount 39 is illustrated and includes a central tie rod 40 having at least threaded ends 41*a*, 41*b* is inserted through vertically aligned openings 15*d*, 28*d* and 32*d*, respectively, of the disks 13, 30, 31 and is of sufficient length that such threaded end 41*a* extend below the lower broad surface 15*b* of the first disk 13 and threaded end 41*b* extends above or well beyond the upper broad surface 28*a* of the second disk 30. Note that while the tie rod 40 does extend below the lower broad surface 15*b* of the first disk 13, it does not intersect or make contact with the upper surface 18*a* of the base 17, see FIG. 3.

Positional relocation of end fasteners or nuts 45 at the ends 41*a*, 41*b* of the tie rod 40 creates a compressional force acting at the upper broad surface 28*a* of the second disk 30 and thence through the lower broad 28*b* to a first spacer tube 46 positioned between the second disc 30 and upper broad surface 32*a* of the intermediate third disk 31. Thereafter, such compressional force is transferred through the lower broad surface 32*b* of the third disk 31 to a second spacer tube 47 positioned between the third disk 31 and the upper surface 15*a* of the first disk 13.

Note that the tubes 46, 47 are identical except for length, so that the description of one also fits the other. As shown, the tube 46, 47 is cylindrical and includes a side wall 50 and a diameter D5. As shown, the tubes 46, 47 are concentric of the axis of symmetry 10 but its diameter D5 much larger that the vertically aligned openings 15*d*, 28*d* and 32*d*, respectively, of the disks 13, 30, 31. Hence, sufficient strength is available to withstand the compressional force exerted by the tie rod 40 after positional relocation of nuts 45, has occurred.

Figure 7:
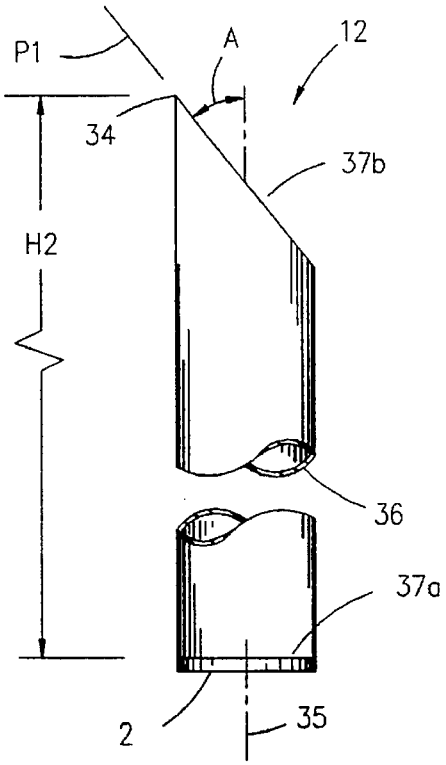
FIG. 7 is a detail side view of one size of incense holder used in the display stand of FIG. 1.
Figure 8:
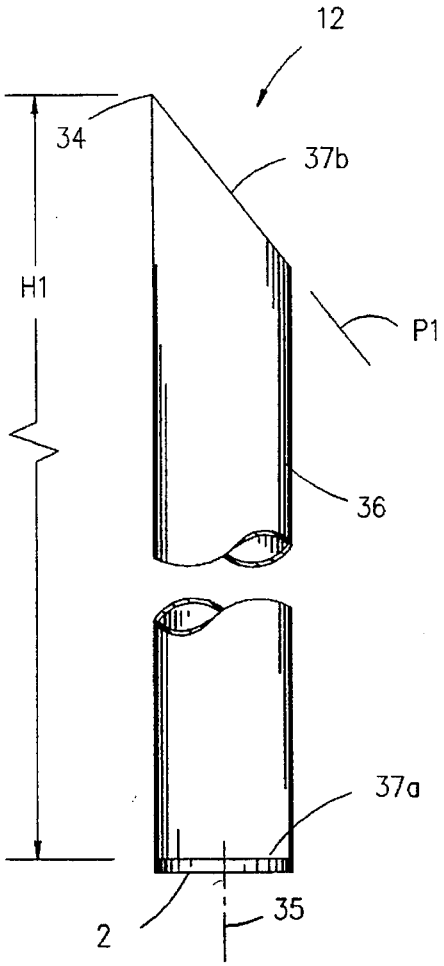
FIG. 8 is a detail side view of another size of holder used in the display stand of FIG. 1.
Figure 9:
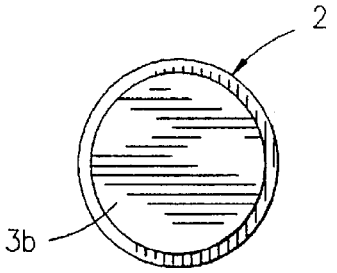
FIG. 9 is a detail front view of an end cap of the holder of FIGS. 7 and 8.
Figure 10:
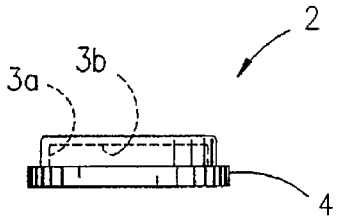
FIG. 10 is a detail side view of the end cap of FIG. 9.

Returning to FIG. 1, note that a cap 48 is attached to the second planar disk 30 for aesthetic purposes. Furthermore, aesthetically speaking, the display of the plurality of incense sticks 8 within the series of incense stick holders 12 is enhanced by the height and orientation of the incense holders 12. That recall that each of the series of stick holders 12 is cylindrical but as shown in FIGS. 7 and 8, the second end terminus 37*b* defines a plane P1 intersecting the axis of symmetry 35 at an included angle A less than 90 degrees. By rotationally positioning the resulting apex segment 34 of each stick holder 12 nearest to the axis of symmetry 10 of the display stand 9, easy access to the incense sticks 8 is provided. In addition, the holders 12 are formed of two common heights H1 and H2. The taller holders 12 associated with common height H1 are located in accordance with the bolt circle F2' in FIG. 6 nearest the axis of symmetry 10 of the display stand 9. Similarly, the shorter holders 12 associated with the common height H2 are located in accordance with the bolt circle F1 fartherest from the axis of symmetry 10 of the display stand 9.

Returning to FIG. 6, note that the incense holders 12 are inserted through the longitudinal openings 33 and thence into contact with cavities 38, see FIG. 2, within the upper broad surface 15*a* of the first disk 13. Hence, retention of the incense, holders 12 is assured.

Additionally, note in FIGS. 1 and 3 that a pair of diametrically opposed chest handles 55 add portability to the display stand 9 of the invention. As shown, the chest handles 55 are mounted to the upper surface 18*a* of the base 17 adjacent to the circumferential edge 18*c*. Such handles 55 each include a base 56 and a curve frame 57 swingable mounted to the base 56.

While the invention has been described with reference to the particular embodiments set forth herein, it should be apparent that the invention is not so confined. Moreover, the invention is intended to cover any modification, departure and change as may come within the scope of the following claims. For example, in FIG. 11, the lower end 41*b* of the tie rod 40 can be fitted with a keyable extension nut into which a shaft of a electric motor can be is attached via a cotter pin to mechanically drive the display stand of the invention in rotation about axis of symmetry 10.

What is claimed is:

1. A portable display stand for displaying a plurality of incense sticks comprising at least a stationary base and first, second and third stacked annular disks of diameters D1, D2 and D3, respectively, positioned above said base and rotatable relative thereto as a single unit, each of said first, second and third stacked annular disks having planar lower and upper broad surfaces, as well as coincident longitudinal axes of symmetry, a plurality of incense holders of cylindrical shape supported on said planar upper broad surface of said first annular disk positioned axially adjacent to said stationary base and extending upward through said planar lower and upper broad surfaces of said second annular disk positioned intermediate between said first and third disks but terminating below said lower surface of said third annular disk, and sticks of incense supported within said plurality of incense holders, said base including a broad upper surface, a series of cross beams of height H having side and top surfaces attached to said broad upper surface of said base at locations offset from said axes of symmetry, a turntable bearing fixedly mounted between said top surfaces of said cross members and said lower surface of said first annular disk and having an rotation axis coincident with said longitudinal axes of symmetry of said first, second and third annular disks, a series of drawers slidably attached to said side surfaces of said cross members for stowage of matches, and a pair of diametrically opposed chest handles attached to said broad surface of said base for easy transport of said display stand including said incense holders and said incense sticks as a single unit to a vending site.

2. The display stand of claim 1 in which said first, second and third annular disks operate as a single unit via a central compression mount that unifies operation of said disks, comprising a tie rod extending through longitudinally aligned openings of said disks, threaded end fasteners releasably attached to tie rod and spacer tubes positioned between said first and second disks and said second and third disks for providing compressional force to said disks to provide single unit operation.

3. The display stand of claim 1 in which said upper broad surface of said third annular disk is fitted with a fire resistant troughs shaped to accept a burning incense stick and wherein said diameter D3 thereof is less than said diameter D2 associated with said intermediate second disk and is less than said diameter D1 associated with first disk.

4. The display stand of claim 3 in which D1 is substantially equal to D2.

5. The display stand of claim 4 in which said stationary base is a solid cylinder defining a diameter D4 wherein D4 is substantially equal D1 and D2.

6. The display stand of claim 1 in which said second disk is provided with a series of openings interconnecting said upper and lower broad surfaces of said second disk, said series of opening defining at least two bolt circles of radius R1 and R2 centered at said coincident axes of symmetry where R1 is greater than R2.

7. The display stand of claim 6 in which said plurality of incense holders of cylindrical shape extend through said series of openings of said disk and in which heights H1 of said incense holders associated with said openings of said bolt circle of radius R1 are shorter that heights H2 of said incense holders associated with said openings of said bolt circle of radius R2.

8. The display stand of claim 7 in which said heights H1 and H2 for each of said plurality of incense holders are measured between a first end surface normal to said axes of symmetry of said first, second and third annular disks and a second end surface cut on a bias to define a apex segment positioned nearest said axes of symmetry.

9. The display stand of claim 8 in which said plurality of incense holders range in number from 15 to 75.

10. The display stand of claim 9 in which said plurality of incense holders range in number from 32 to 50.

11. In the display of a plurality of incense sticks, the combination comprising a portable table having foldable legs extendable to provide a upper surface substantially parallel to the earth's surface, a display stand supported on said upper surface of said portable table, said display stand comprising at least a stationary base in releasable contact with said upper surface of said portable table and first, second and third stacked annular disks of diameters D1, D2 and D3, respectively, positioned above said base and rotatable relative thereto as a single unit, each of said first, second and third stacked annular disks having planar lower and upper broad surfaces, as well as coincident longitudinal axes of symmetry, a plurality of incense holders of cylindrical shape supported on said planar upper broad surface of said first annular disk positioned axially adjacent to said stationary base and extending upward through said planar lower and upper broad surfaces of said second annular disk positioned intermediate between said first and third disks but terminating below said lower surface of said third annular disk, and sticks of incense supported within said plurality of incense holders, said base including a broad upper surface, a series of cross beams of height H having side and top surfaces attached to said broad upper surface of said base at locations offset from said axes of symmetry, a turntable bearing fixedly mounted between said top surfaces of said cross members and said lower surface of said first annular disk and having an rotation axis coincident with said longitudinal axes of symmetry of said first, second and third annular disks, a series of drawers slidable attached to said side surfaces of said cross members for stowage of matches, and a pair of diametrically opposed chest handles attached to said broad surface of said base for easy transport of said display stand including said incense holders and said incense sticks as a single unit to a vending site.

12. The combination of claim 11 in which said first, second and third annular disks operate as a single unit via a central compression mount that unifies operation of said disks, comprising a tie rod extending through longitudinally aligned openings of said disks, threaded end fasteners releasably attached to tie rod and spacer tubes positioned between said first and second disks and said second and third disks for providing compressional force to said disks to provide single unit operation.

13. The combination of claim 11 in which said upper broad surface of said third annular disk is fitted with a fire resistant troughs shaped to accept a burning incense stick and wherein said diameter D3 thereof is less than said diameter D2 associated with said intermediate second disk and is less than said diameter D1 associated with first disk.

14. The combination of claim 13 in which D1 is substantially equal to D2.

15. The combination of claim 14 in which said stationary base is a solid cylinder defining a diameter D4 wherein D4 is substantially equal D1 and D2.

16. The combination of claim 11 in which said second disk is provided with a series of openings interconnecting said upper and lower broad surfaces of said second disk, said series of opening defining at least two bolt circles of radius R1 and R2 centered at said coincident axes of symmetry where R1 is greater than R2.

17. The combination of claim 16 in which said plurality of incense holders of cylindrical shape extend through said series of openings of said disk and in which heights H1 of said incense holders associated with said openings of said bolt circle of radius R1 are shorter that heights H2 of said incense holders associated with said openings of said bolt circle of radius R2.

18. The combination of claim 17 in which said heights H1 and H2 for each of said plurality of incense holders are measured between a first end surface normal to said axes of symmetry of said first, second and third annular disks and a second end surface cut on a bias to define a apex segment positioned nearest said axes of symmetry.

19. The combination of claim 18 in which said plurality of incense holders range in number from 15 to 75.

20. The combination of claim 19 in which said plurality of incense holders range in number from 32 to 50.

* * * * *